US006392517B1

(12) United States Patent
Coleman, Jr. et al.

(10) Patent No.: US 6,392,517 B1
(45) Date of Patent: May 21, 2002

(54) MAGNETIC RETRIEVAL TOOL WITH INCREASED FLUX

(75) Inventors: Edward S. Coleman, Jr., Ridgefield, CT (US); Stanley Stromski, Riverhead, NY (US)

(73) Assignee: Ullman Devices, Ridgefield, CT (US)

( * ) Notice: Subject to any disclaimer, the term of this patent is extended or adjusted under 35 U.S.C. 154(b) by 0 days.

(21) Appl. No.: 09/707,473

(22) Filed: Nov. 7, 2000

(51) Int. Cl.[7] ..... H01F 7/20
(52) U.S. Cl. ..... 335/285; 294/65.5; 81/24
(58) Field of Search ..... 294/65.5; 81/24; 335/285, 302–306

(56) References Cited

U.S. PATENT DOCUMENTS

| | | | | |
|---|---|---|---|---|
| 2,471,764 A | | 5/1949 | Miller et al. | |
| 2,517,325 A | | 8/1950 | Lamb | |
| 2,637,590 A | | 5/1953 | Ortloff | |
| 2,732,243 A | | 1/1956 | Mount | |
| 2,778,669 A | | 1/1957 | Goodwin | |
| 2,790,116 A | | 4/1957 | Kirby, II | |
| 2,830,663 A | | 4/1958 | Kirby, II | |
| 2,830,664 A | | 4/1958 | Kirby, II | |
| 2,853,331 A | | 9/1958 | Teetor | |
| 2,915,681 A | | 12/1959 | Troy | |
| 2,947,563 A | | 8/1960 | Stitt | |
| 2,976,075 A | | 3/1961 | Budreck | |
| 3,086,268 A | | 4/1963 | Chaffin, Jr. | |
| 3,169,791 A | | 2/1965 | Twachtman | |
| 3,223,898 A | | 12/1965 | Bey | |
| 3,253,194 A | | 5/1966 | Parker | |
| 3,297,352 A | * | 1/1967 | Larrison et al. | 81/24 |
| 3,384,408 A | | 5/1968 | Furzey | |
| 3,582,123 A | | 6/1971 | Kyser | |
| 3,646,492 A | | 2/1972 | Westerman | |
| 3,789,336 A | | 1/1974 | Gordin | |
| 4,105,239 A | | 8/1978 | Akczinski, Jr. | |
| 4,178,029 A | | 12/1979 | LaPan | |
| D276,690 S | | 12/1984 | Hamatani | |
| 4,554,703 A | | 11/1985 | Matuki | |
| 4,575,143 A | | 3/1986 | Nast | |
| 4,802,702 A | | 2/1989 | Bownds | |
| 4,813,729 A | | 3/1989 | Speckhart | |
| 4,943,098 A | | 7/1990 | Aoyama | |
| 5,169,193 A | | 12/1992 | Stelmach | |
| D334,519 S | | 4/1993 | Arnold | |
| 5,249,832 A | | 10/1993 | Leonardz | |
| 5,288,119 A | | 2/1994 | Crawford, Jr. et al. | |
| 5,348,359 A | | 9/1994 | Boozer | |
| 5,381,319 A | | 1/1995 | Shiao | |
| 5,395,148 A | | 3/1995 | Jameson et al. | |
| 5,433,492 A | | 7/1995 | Glossop, Jr. | |
| 5,472,253 A | | 12/1995 | Resor | |
| D378,337 S | | 3/1997 | Reynolds et al. | |
| 5,647,623 A | * | 7/1997 | Shiao | 294/65.5 |
| 5,945,901 A | | 8/1999 | Coleman, Jr. et al. | |
| 5,999,074 A | | 12/1999 | Coleman, Jr. et al. | |

FOREIGN PATENT DOCUMENTS

| | | |
|---|---|---|
| AT | 175645 | 7/1953 |

* cited by examiner

*Primary Examiner*—Lincoln Donovan
(74) *Attorney, Agent, or Firm*—Bachman & LaPointe, P.C.

(57) ABSTRACT

A magnetic retrieval tool, includes a magnet holder having a cylindrical wall having a rear portion and a front portion, the wall defining a space for holding a magnet, the wall decreasing in thickness from the rear portion toward the front portion, and a magnet disposed in the space, wherein the magnet holder concentrates flux from the magnet at the front portion.

11 Claims, 1 Drawing Sheet

MAGNETIC RETRIEVAL TOOL WITH INCREASED FLUX

BACKGROUND OF THE INVENTION

The invention relates to a magnetic retrieval tool and, more particularly, to a head portion of a magnetic retrieval tool which provides for increased lifting power as compared to conventional magnetic devices.

Various types of magnetic retrieval tools are known and used, for example by mechanics and other technicians who must commonly retrieve ferrous or other magnetically attractable articles from difficult-to-reach locations. Examples of such devices are disclosed in U.S. Pat. No. 5,945,901, and U.S. Pat. No. 5,999,074, and others.

Although the devices disclosed in the foregoing patents are useful for retrieving various articles from difficult-to-reach places, the need remains for such a device wherein the magnet has substantially increased lifting power so that heavier objects can also be retrieved.

It is the primary object of the present invention to provide such an apparatus.

It is a further object of the present invention to provide a magnetic retrieval tool which is simple and inexpensive in manufacture.

Other objects and advantages of the present invention will appear hereinbelow.

SUMMARY OF THE INVENTION

In accordance with the present invention, the foregoing objects and advantages have been readily attained.

According to the invention, a magnetic retrieval tool is provided which comprises a magnet holder comprising a cylindrical wall having a rear portion and a front portion, said wall defining a space for holding a magnet, said wall decreasing in thickness from said rear portion toward said front portion, and a magnet disposed in said space, wherein said magnet holder concentrates flux from said magnet at said front portion.

BRIEF DESCRIPTION OF THE DRAWINGS

A detailed description of preferred embodiments of the present invention follows, with reference to the attached drawings, wherein.

DETAILED DESCRIPTION

Figure 1:
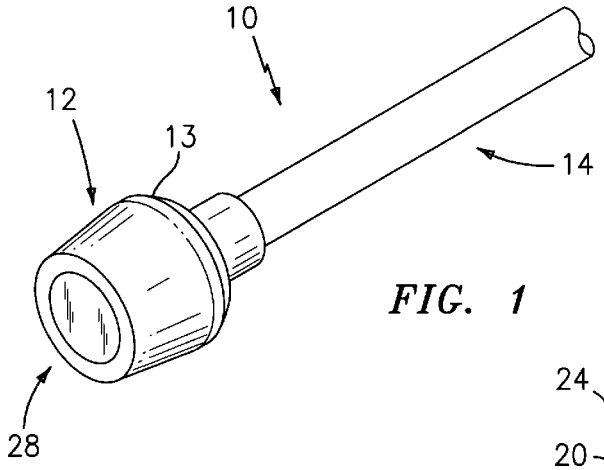
FIG. 1 is a perspective view of a magnetic retrieval tool in accordance with the present invention.

Referring to the drawings, FIG. 1 shows a perspective view of a magnetic retrieval tool 10 in accordance with the present invention including a magnet head 12 and a handle portion 14. In accordance with the present invention, magnet head 12 has a structure which provides for an increase in flux at the pickup surface of the device, thereby providing the magnet with a greater lifting capacity than magnets in conventional retrieval tools.

Figure 2:
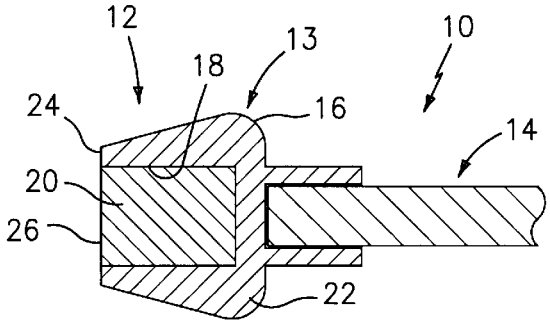
FIG. 2 is a cross-sectional view of a magnetic retrieval tool in accordance with the present invention.

Referring also to FIG. 2, magnet head 12 in accordance with the present invention preferably includes a holder 13 which is preferably a generally cylindrical wall 16 which defines an inner space 18 for holding a magnet 20. Wall 16 preferably has a wall thickness which decreases from a rear portion 22 of magnet head 12 toward a front edge 24 of same, and which has been found to concentrate flux at front edge 24 so as to increase flux density or gauss at the pickup surface and increase the lifting capacity of the tool.

As shown in FIG. 2, wall 16 is provided having a thickness at rear portion 22 which is greater than the thickness of wall 16 at front edge 24. As will be discussed below, this difference in wall thickness advantageously provides for the desired benefits according to the invention.

As shown, magnet 20 is preferably disposed within space 18 and has a front surface 26 which is preferably arranged to be substantially coplanar with front edge 24 of wall 16 so as to define, in combination, a pickup surface for tool 10. The pickup surface is shown in FIGS. 1 and 3 by reference number 28.

In accordance with the present invention, the decreasing thickness from rear portion 16 toward front portion 24 serves to concentrate flux in pickup surface 28, particularly in front edge 24 of wall 16, and thereby enhances the magnetic attraction and lifting power of magnet head 12 as compared to conventional retrieval tools. This is particularly advantageous in that a tool is provided which can retrieve heavier objects from difficult-to-reach places using the same magnet as conventional devices.

Figure 3:
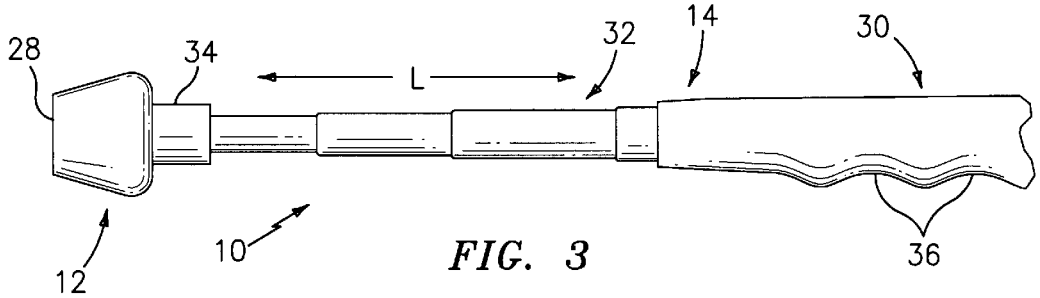
FIG. 3 further illustrates a magnetic retrieval tool having a telescopic handle section in accordance with the preferred embodiment of the present invention.

Referring to FIGS. 1–3 collectively, cylindrical wall 16 is preferably provided having an inner surface which defines space 18 such that space 18 is substantially cylindrical and has a substantially constant diameter or circumference, as best shown in FIG. 2. This facilitates assembly and mounting of magnet 20.

Figure 4:
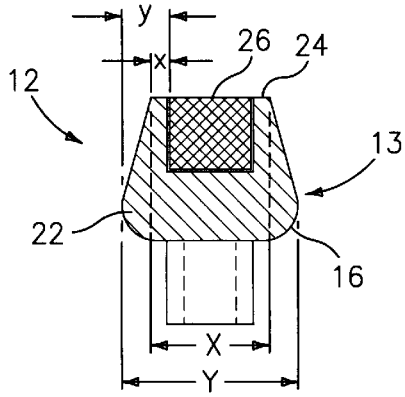
FIG. 4 further illustrates a preferred configuration of magnet head according to the invention.

Wall 16 is preferably provided having an outer surface which slopes, preferably in a substantially straight manner, from the thickest portion Y to the thinnest portion X (see FIG. 4). FIG. 4 shows holder 13 having the thickest portion Y defined at the rear of magnet head 12, at a position which is behind magnet 20, and shows thinnest portion X defined at front edge 24 which defines, in combination with magnet 20, the pickup surface of the device.

Figure 5:
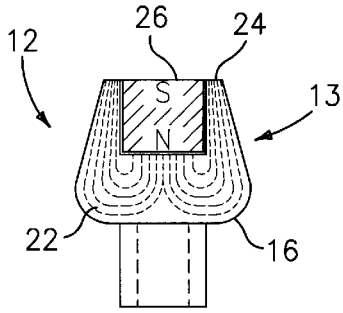
FIG. 5 schematically illustrates flux through the magnet head of the present invention.

As shown in FIG. 5, flux emanating from the rearwardly-directed pole of magnet 20 passes through wall 16 at a relatively lower flux density, and the flux, which is illustrated schematically by the dashed lines in FIG. 5, is concentrated as it approaches front edge 24, thereby providing the desired increase in gauss or flux density, which provides magnet head 12 in accordance with the present invention with enhanced pickup capacity.

In accordance with the present invention, a suitable magnet head may be provided having various different dimensions. One particularly preferred embodiment of a magnet head in accordance with the present invention has a thickness Y of about 0.875 inches, and a thickness X of about 0.703 inches, so as to provide a ratio of thickest portion X to thinnest portion Y of approximately 1.25. It is preferred that thicknesses X and Y be selected so as to provide a ratio of thickness Y to thickness X of between about 1.1 and about 1.5. This range is selected balancing the need to concentrate as much flux as is possible with the loss influx which would result from too great of a ratio. As set forth above, a particularly preferred ratio is about 1.25. Still referring to FIG. 4, the magnet head 12 being illustrated is substantially round in cross section, and thicknesses Y and X are therefore diameters of same. In addition to ratio of diameters, it has also been found that the particular relationship of wall thickness of holder 13 is relevant to providing the advantageous results desired in accordance with the present invention. Thus, FIG. 4 shows holder 13 having a wall thickness y at rear portion 22 and a wall thickness x at front edge 24. In one particularly preferred embodiment of the present invention, thickness y may suitably be about 0.200 inches, and thickness x may suitably be about 0.100 inches. This also is found to provide for a desirable concentration of flux from the rear of the magnet head to the front edge thereof, without loss of a significant amount of flux. Balancing these concerns, it is preferred that the ratio of wall thickness y to wall thickness x be between about 1.5 and about 2.5, preferably about 2.

FIGS. 1 and 2 show handle member 14 as a simple rod. In accordance with a preferred embodiment of the present invention, handle member 14 may be provided having a handgrip member 30 as shown in FIG. 3, and also may be provided having a telescopic section 32 which can be used to increase and decrease the length L of tool 10 as desired. Telescopic section 32 may advantageously be secured into a sleeve member 34 extending rearwardly from wall section 16, and handgrip member 30 may advantageously be mounted to telescopic section 32 through any known manner. Further, handgrip member 30 may be adapted to have finger grip portions 36 and may be provided of a material selected to provide comfortable grip while resisting damage in an expected environment of use, for example by a mechanic.

It is preferred that wall member 16 be provided of a material which will concentrate flux as desired. Preferably, member 16 is fabricated from soft low carbon steel, although other materials are suitable. This material has been found in accordance with the present invention to ideally concentrate flux from magnet 20 at front surface 24 as desired in accordance with the present invention.

It is preferred that wall member 16 be provided of a material which will concentrate flux as desired. Preferably, member 16 is fabricated from a magnetic material such as soft low carbon steel, although other materials are suitable. This material has been found in accordance with the present invention to ideally concentrate flux from magnet 20 at front surface 24 as desired in accordance with the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A magnetic retrieval tool, comprising a magnet holder comprising a cylindrical wall having a rear portion and a front portion, said wall defining a space for holding a magnet, said wall decreasing in thickness from said rear portion toward said front portion, and a magnet disposed in said space, wherein said magnet holder concentrates flux from said magnet at said front portion and wherein said wall is formed of soft low carbon steel.

2. The apparatus of claim 1, wherein said wall has a front edge and said magnet has a front surface, said front edge and said front surface defining a pickup surface for attracting ferrous objects.

3. The apparatus of claim 2, wherein said wall has a front wall thickness at said front edge and a rear wall thickness at said rear portion, and wherein a ratio of said rear wall thickness to said front wall thickness is between 1.5 and 2.5.

4. The apparatus of claim 3, wherein said ratio is 2.

5. The apparatus of claim 1, wherein said wall defines said space as a constant diameter cylinder, and wherein said wall has an outer surface sloping inwardly with respect to an axis of said magnet holder from said rear portion toward said front portion.

6. The apparatus of claim 5, wherein said wall defines a rear diameter at said rear portion and a front diameter at said front edge, and wherein a ratio of said rear diameter to said front diameter is between 1.1 and 1.5.

7. The apparatus of claim 6, wherein said ratio is about 1.25.

8. A magnetic retrieval tool, comprising a magnet holder comprising a cylindrical wall having a rear portion and a front portion, said wall defining a space for holding a magnet, said wall being made of a magnetic material and decreasing in thickness from said rear portion toward said front portion, and a magnet disposed in said space, wherein said magnet holder concentrates flux from said magnet at said front portion.

9. The apparatus according to claim 1, wherein said magnet is selected from the group consisting of rubber magnets, alnico magnets, and rare earth magnets.

10. The apparatus of claim 1, further comprising a handle member extending rearwardly from said rear portion of said wall.

11. The apparatus according to claim 10, wherein said handle includes a telescoping section for adjusting length of said tool.

* * * * *